US005887646A

United States Patent [19]

Evans et al.

[11] Patent Number: 5,887,646

[45] Date of Patent: Mar. 30, 1999

[54] MODULAR SAND MOLD SYSTEM FOR METAL TREATMENT AND CASTING

[75] Inventors: Walter Evans, Plymouth; Leslie Terner, West Bloomfield; Frank Tibaudo, Grosse Pointe Woods, all of Mich.

[73] Assignee: Ford Global Technologies, Inc., Dearborn, Mich.

[21] Appl. No.: 784,328

[22] Filed: Jan. 16, 1997

[51] Int. Cl.[6] ..... B22C 9/02; B22C 9/08

[52] U.S. Cl. ..... 164/364; 164/358; 164/349

[58] Field of Search ..... 164/364, 358, 164/58.1, 55.1, 29, 136, 349

[56] References Cited

U.S. PATENT DOCUMENTS

| | | | |
|---|---|---|---|
| 3,382,914 | 5/1968 | Fiedler et al. . | |
| 3,402,756 | 9/1968 | Frehser et al. . | |
| 3,514,285 | 5/1970 | Bakkerus . | |
| 3,703,922 | 11/1972 | Dunks et al. . | |
| 3,991,810 | 11/1976 | Nieman . | |
| 4,004,630 | 1/1977 | Dunks . | |
| 4,040,468 | 8/1977 | Nieman . | |
| 4,412,578 | 11/1983 | Doliwa et al. . | |
| 4,424,853 | 1/1984 | Khandros et al. . | |
| 4,436,142 | 3/1984 | Mather . | |
| 4,638,846 | 1/1987 | Ackerman et al. . | |
| 4,690,196 | 9/1987 | Vernay | 164/58.1 |
| 4,779,663 | 10/1988 | Pruyne et al. . | |
| 4,806,157 | 2/1989 | Subramanian . | |
| 4,913,218 | 4/1990 | Seindinger | 164/364 |
| 5,038,846 | 8/1991 | Doty | 164/58.1 |
| 5,402,843 | 4/1995 | Skibo . | |

FOREIGN PATENT DOCUMENTS

| | | | |
|---|---|---|---|
| 1592110A | 9/1990 | U.S.S.R. | 164/364 |
| 1688970A | 11/1991 | U.S.S.R. | 164/364 |
| 1792799A1 | 2/1993 | U.S.S.R. | 164/58.1 |

*Primary Examiner*—Patrick Ryan
*Assistant Examiner*—I.-H. Lin
*Attorney, Agent, or Firm*—Joseph W. Malleck

[57] ABSTRACT

A portable sand mold metal treating system having sand cope and sand drag portions, the treating system being attachable to a sand mold metal casting system. The treating system comprises (a) a sand cope portion and a sand drag portion mateable at one or more parting planes, the cope portion containing a tapered entry sprue which extends to the parting plane and contains a slag chamber lying along the parting plane, the drag containing a runner that communicates with the bottom of the slag trap lying along the parting plane, the drag portion containing a sprue well, a reaction chamber having its top lying in the parting plane and overlapping the slag trap to be open thereto, a runner that provides a path for metal flow between the sprue well and one side of the reaction chamber; (b) a mixing channel in the drag portion communicating with an opposite side of the bottom of the slag trap; (c) a tapered secondary sprue extending from the mixing channel to an exterior side of the system to define an outlet port at a level below the reaction chamber; and (d) a flow choke in the secondary sprue for restricting the flow of metal from the mixing channel to ensure adequate mixing and homogenization of the treated metal therein.

7 Claims, 2 Drawing Sheets

METAL FLOW PATH

METAL FLOW PATH

MODULAR SAND MOLD SYSTEM FOR METAL TREATMENT AND CASTING

BACKGROUND OF THE INVENTION

Technical Field

This invention relates to the technology of in-mold treatment of molten metal to achieve metallurgical modifications and more particularly to the technology of carrying out such treatment utilizing highly reactive materials such as magnesium, containing alloys for creating compacted graphite cast iron or nodular graphite cast iron.

Discussion of the Prior Art

Heretofore in-mold treating systems have fully contained the treatment chamber in the sand casting mold box so that the molten metal being cast is treated during pouring of the casting. Close proximity of the reaction site to the casting cavity was deemed desirable so that the volatile reaction could be conveniently contained and so that the time dependent fading of the reaction effect would be eliminated or not be significant. A disadvantage to carrying out in-mold treatment in the same mold box in which the casting is made is that the physical system requires additional space on the mold pattern and is a disincentive to modify the casting, since this would also affect the treating system and require a redetermination of treatment parameters and additional changes to the mold pattern. Manufacturing flexibility is thereby highly inhibited.

There have been attempts by the prior art to utilize a pouring pressure head separated from the casting mold and which head sits on top of the mold (see U.S. Pat. No. 4,779,663). But, even with this adaptation, the reaction chamber and slag trap are still in the casting mold. The problem of inflexibility is particularly severe when considering experimental or prototype pattern or mold designs which are likely to be frequently changed and used in low volume.

Another associated problem with in-mold treatment is the risk of short-term variability of the base metal being treated or the reaction properties of the treatment alloy itself. Such variability can affect the robustness of the treatment process and the resultant properties of the compacted graphite or nodular cast irons. The reaction chamber and runner system can be of a universal shape that assists in overcoming such variabilities.

SUMMARY OF THE INVENTION

It is an object of this invention to provide a solution to the above problems by the use of a sand mold treating system that is separate from the sand mold casting system, which sand mold treating system is portable and transferable, and which system is universally effective in promoting robust and optimal physical properties in the treated metal.

The invention herein that fully meets the above object is, in a first aspect, a portable sand mold metal treating system having sand cope and sand drag portions, the treating system being attachable to a sand mold metal casting system. The portable sand mold treating system comprises (a) a sand cope portion and a sand drag portion mateable at one or more parting planes, the cope portion containing a tapered entry sprue which extends to the parting plane and contains a slag trap lying along the parting plane, the drag portion containing a sprue well, a reaction chamber having its top lying in the parting plane and overlapping the slag trap to be open thereto, a runner that provides a path for metal flow between the sprue well and one side of the reaction chamber; (b) a mixing channel in said drag portion communicating with an opposite side of the bottom of the slag trap; (c) a tapered secondary sprue extending from said mixing channel to an exterior side of the system to define an outlet port at a level below the reaction chamber; and (d) a flow choke in said secondary sprue for restricting the flow of metal from the mixing channel to ensure adequate mixing and homogenization of the treated metal therein.

The invention, in a second aspect, is a modular sand mold assembly having a first part in the form of a portable sand mold metal treating system which is defined as indicated above, and a second part in the form of a sand mold casting system having a cope defining the upper part of a casting cavity and a drag defining the lower part of the casting cavity, the sand mold metal casting system having a runner system communicating the outlet port of the metal treating system with one or more ingates to the casting cavity.

The invention, in a third aspect, is a method of feeding and treating molten metal within a sand mold system having a casting cavity, the method comprising (a) exposing a streamlined flow of molten metal to the exposed surface of a recessed treating alloy; and (b) flowing the treated metal thence quiescently through a slag trap located above the reaction chamber to separate slag from the treated metal, (c) passing the treated and deslagged metal into a mixing channel and thence into a secondary sprue for streamlining the metal flow again for filling the casting cavity; and, (d) choking the flow from the mixing channel to promote a longer dwell of the molten metal upstream of said choke.

DETAILED DESCRIPTION AND BEST MODE

Cast irons with nodular or vermicular graphite morphologies occupy a key position among the materials produced by the foundry industry. Certain elements, especially magnesium, when added to molten cast iron have a strong effect on the final metal structure, particularly the graphite morphology. Proper treatment can greatly improve mechanical properties of the cast iron without a large change in the metal's chemical composition. Treating with such elements in the casting mold is an effective way to obtain such improvements. To provide for mold-to-mold treatment flexibility without having to modify the actual casting pattern, a simple low cost portable sand mold treating system is disclosed which can be attached to an existing sand mold casting system to implement in-mold metal treatment. Such separate and portable treatment system provides several advantages; it is simple, inexpensive to produce, safe to use with highly reactive inoculatants, and is adaptable to any new or existing sand mold casting system without alternation of the existing pattern. The reaction chamber size can be more easily changed and verified from mold casting system to mold casting system. The portable sand mold treating system is relatively light weight and is especially suitable for prototype casting or low volume production, where the treating system may be changed often and it is either not expedient or feasible to modify the casting pattern to include the appropriate treatment system.

The in-mold treating concept is one in which an intermediate reaction chamber is located between the pouring sprue and the in-gate to the casting cavity itself. The intermediate reaction chamber receives a treatment alloy or graphitizer in the form of pellets, granules or even a solid cast alloy so that the base molten metal passes over or through the alloy to create a reaction just prior to entering the in-gate of the casting cavity to produce a modification to the structure of the solidifying metal. Much concern has been devoted by the prior art to the shape of the intermediate reaction chamber so that there is appropriate dwell time to allow the alloy to properly treat molten metal as it flows therepast. In spite of such shaping of the intermediate reaction chamber by the prior art, there still remains a risk that not all of the molten metal has been properly treated because of inadequate contact of the metal with the treating alloy, variability within the base iron and/or treatment alloy, and inadequate mixing of the treated metal itself.

Figure 1:
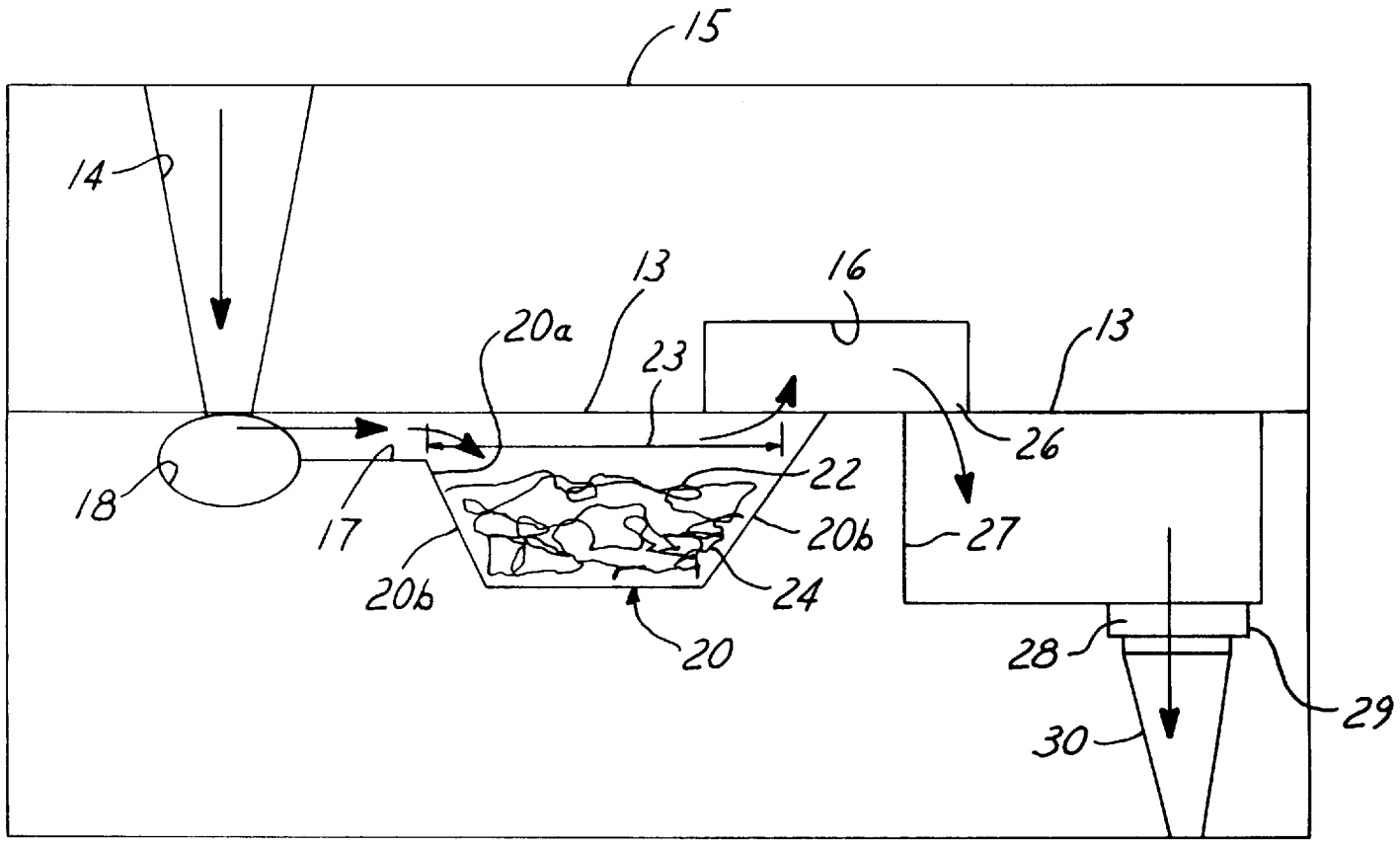
FIG. 1 is a schematic sectional elevational view of a flexible portable modularized metal treating sand mold system in accordance with this invention; and, FIG. 2 is a schematic sectional elevational view depicting the combination of a portable metal-treating sand mold and a metal casting sand mold.
Figure 2:
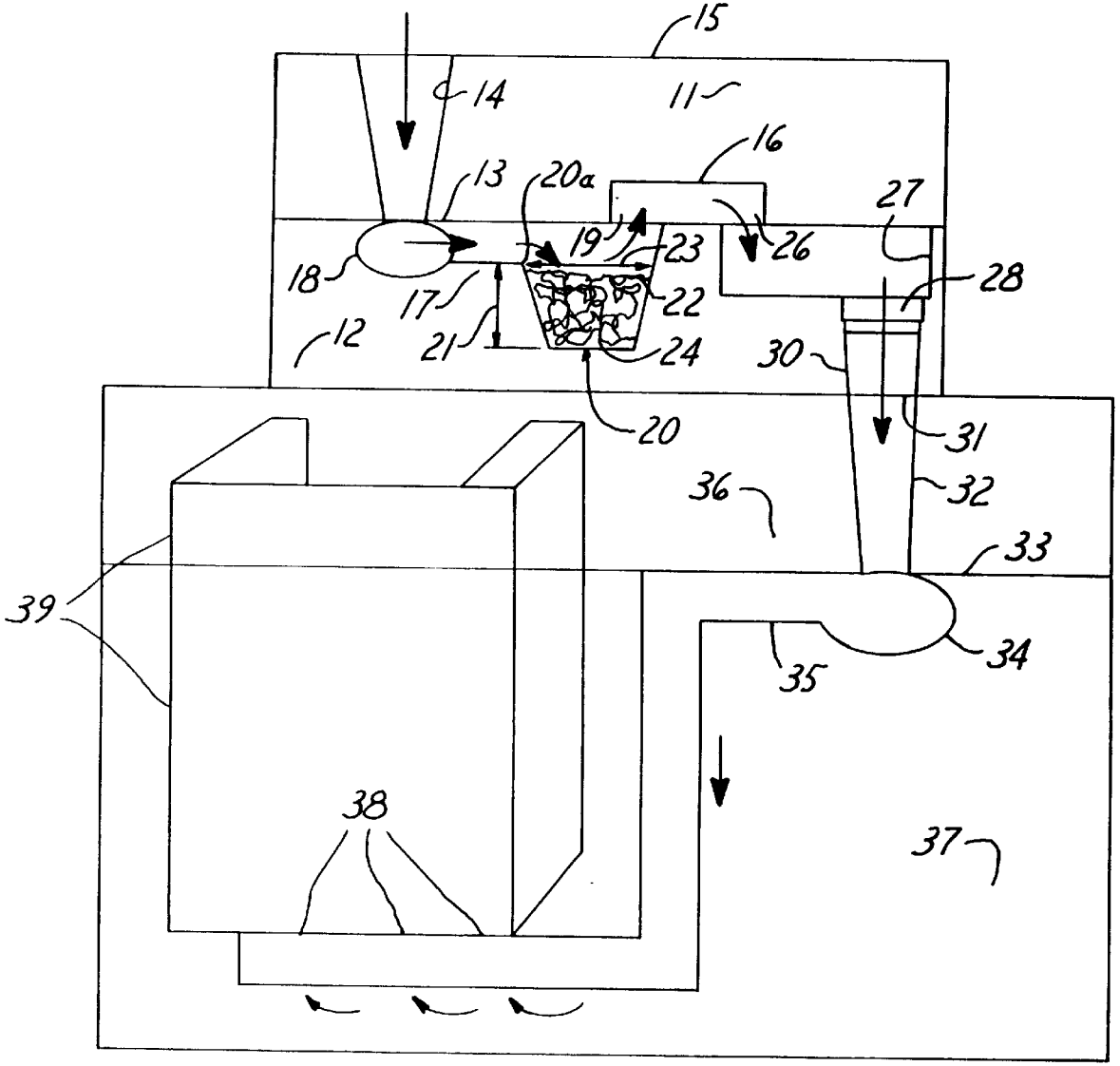

As shown in FIG. 1, a modular portable sand mold system 10 is comprised of a cope portion 11 and a drag portion 12 mating along one or more parting planes 13. The cope portion 11 has an entry sprue 14 extending to the parting plane 13. The entry sprue is a tapered, conically shaped channel oriented to extend in a vertical direction from the top 15 of the cope to the parting plane 13 and has a cross section determined by the required flow rate of the molten iron. Details of sprue and runner design should be in accordance with sound foundry practice. The cope portion also has a slag trap chamber 16 lying along the parting plane 13 and is preferably shown as a rectangular chamber that intersects with the parting plane 13 along a length of generally 4 inches and has a height of about 1–2 inches.

The drag portion 12 has a runner channel 17 communicating sprue well 18 (at the bottom of the entry sprue) with one side 20*a* of a reaction chamber 20 recessed in the drag portion from the parting plane 13. The sprue well 18 is shaped to smoothly turn the flow of molten metal being received from the entry sprue into a horizontal flow within the runner. The flow passes into the reaction chamber 20 by dropping slightly (at least 0.5 inches) to meet the top interface of the treating alloy in such chamber. The reaction chamber has a square or slightly rectangular interface area 22, with the flow thereacross, which area is determined by the desired flow rate and concentration of treatment. The reaction chamber may have a height-to-width ratio of about 2–3; if the height 21 (measured from the runner) is about 5 inches, the width 23 should be about 1.66–2.5 inches. The reaction chamber is filled with an inoculating alloy 24, generally granular, to a level below the runner 17 so that molten metal entering the chamber flows downwardly to more thoroughly react with the alloy. The side walls 20*b* are at a taper or draft angle (3°–30°) with respect to a vertical plane. The amount of taper can be used to universalize the selection of the interface area and the base metal or alloy (which can influence the metallurgical reaction rate). The flow from the reaction chamber exits by way of an outlet 19 into the slag trap 16; the outlet 19 is typically designed to restrict flow from the reaction chamber to keep it filled with molten metal.

The drag portion 12 also has a mixing chamber 27 that communicates with an opposite side 26 of the slag chamber 16. The metal flow passes, as indicated, through a channel 25 from the slag trap chamber to the mixing chamber 27, the dimensions of which are determined by the flow rate needed for the particular casting application but should be at least 3 times the volume of the reaction chamber. The mixing chamber outlet (or proximate thereto) contains a flow choke 28 in the form of a disc 29, generally of low carbon steel, to delay the initial molten metal flow out of the mixing chamber to the casting cavity to promote proper mixing. By exercising proper control of the total amount of molten metal poured, the amount of metal left in the mixing chamber after the casting cavity is filled will be kept to a minimum. The use of the mixing chamber increases the uniformity of alloy element distribution throughout the cast part. The molten metal flows through a secondary sprue 30, which is a tapered conically shaped channel and is connected to a conically shaped sprue section 32 located in an independent sand mold casting system 40. The cross-sectional and 31 of the casting mold sprue 32 may be reduced to accommodate or throttle the increased metal head pressure resulting from use of the sand mold portable treating system 10.

The independent sand mold casting system 40 comprises a cope 36 which defines an upper part of a casting cavity 39 and a drag 37 which defines the bottom part of the casting cavity 39. The sand mold cope 36 is connected to the drag of the portable sand mold system 12 in such a way that the molten metal can flow through area 31 without interference. The secondary sprue 32 connects to a sprue well 34 which communicates with a runner system 35 that receives the flow from the secondary sprue. The runner system 35 (designed appropriately for the specific casting) leads the metal flow to one or more in-gates 38 at the entry to the casting cavity 39.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A portable sand mold metal treating system having sand cope and sand drag portions, the treating system being attachable to a sand mold metal casting system, the treating system comprising;

(a) a sand cope portion and a sand drag portion mateable at one or more parting planes, the cope portion containing a tapered entry sprue which extends to the parting plane and contains a slag trap lying along the parting plane, the drag portion containing a sprue well, a reaction chamber having its top lying in said parting plane and overlapping said slag trap to be open thereto, a runner that provides a path for metal flow between the sprue well and one side of the reaction chamber;

(b) a mixing channel in the drag portion communicating with an opposite side of the bottom of the slag trap;

(c) a tapered secondary sprue extending from said mixing channel to an exterior side of the system to define an outlet port at a level below said reaction chamber; and (d) a flow choke in said secondary sprue for restricting the flow of metal from the mixing channel to ensure adequate mixing and homogenization of the treated metal therein.

2. The treating system as in claim 1 in which said secondary sprue extends to the bottom of the drag portion.

3. The treating system as in claim 1 in which the mixing channel extends to a side of the drag portion.

4. The treating system as in claim 1 in which said reaction chamber has tapered walls with a draft angle of 3°–30° with respect to a vertical plane to vary the receding interface, between granular treating alloy held therein, and molten metal flowing thereacross.

5. The treating system as in claim 1 in which said flow choke is an iron disc dislocated in the entrance to said secondary sprue.

6. The treating system as in claim 1 in which the flow choke is a steel disc located in the outlet of said mixing channel.

7. A modular sand mold, comprising:

(a) a first part in the form of a portable sand mold metal treating system having sand cope and sand drag portions, and being attachable to a sand mold metal casting system, the portable sand mold treating system comprising (i) a sand cope portion and a sand drag portion mateable at one or more parting planes, the cope portion containing an entry sprue which extends to the parting plane and contains a slag trap lying along the parting plane, the drag portion containing a reaction chamber open to one side of said slag trap and a runner that communicates with the bottom of the entry sprue and with one side of the reaction chamber; (ii) a mixing channel in the drag portion communicating with an opposite side of said slag trap and (iii) a secondary sprue extending from the mixing channel to an outlet port of the system; and (b) a second part in the form of a sand mold casting system having a cope defining the upper part of a casting cavity and a drag defining the lower part of such casting cavity, the sand mold metal casting system having a runner system communicating with the outlet port of the metal treating system and with one or more in-gates to the casting cavity.

* * * * *